US010563505B2

(12) United States Patent
Villareal et al.

(10) Patent No.: US 10,563,505 B2
(45) Date of Patent: Feb. 18, 2020

(54) SAMPLE CAPTURE PRIORITIZATION

(75) Inventors: Steven Villareal, Cheltenham (GB); Julian Pop, Houston, TX (US); Shahid A. Haq, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 873 days.

(21) Appl. No.: 14/241,853

(22) PCT Filed: Aug. 31, 2012

(86) PCT No.: PCT/US2012/053362

§ 371 (c)(1),
(2), (4) Date: May 5, 2014

(87) PCT Pub. No.: WO2013/033547

PCT Pub. Date: Mar. 7, 2013

(65) Prior Publication Data

US 2014/0290941 A1 Oct. 2, 2014

Related U.S. Application Data

(60) Provisional application No. 61/530,199, filed on Sep. 1, 2011.

(51) Int. Cl.

| | |
|---|---|
| ***E21B 49/08*** | (2006.01) |
| ***E21B 47/18*** | (2012.01) |
| ***E21B 49/10*** | (2006.01) |

(52) U.S. Cl.

CPC ..... *E21B 49/084* (2013.01); *E21B 47/18* (2013.01); *E21B 49/08* (2013.01); *E21B 49/10* (2013.01)

(58) Field of Classification Search

CPC ..... E21B 49/08; E21B 49/10; E21B 49/082; E21B 49/084; E21B 47/18; E21B 33/1243

See application file for complete search history.

(56) References Cited

U.S. PATENT DOCUMENTS 3,859,850 A * 1/1975 Whitten ..... E21B 49/10 73/152.24
4,535,843 A * 8/1985 Jageler ..... E21B 33/1243 166/187
4,633,952 A * 1/1987 Ringgenberg ..... E21B 23/006 166/250.08

(Continued)

FOREIGN PATENT DOCUMENTS

EA 007962 B1 2/2007
EA 200870078 A1 12/2009

(Continued)

OTHER PUBLICATIONS

Examination Report for corresponding AU App No. 2012301699, dated Oct. 16, 2015, 6 pages.

(Continued)

*Primary Examiner* — Lina M Cordero

(57) ABSTRACT

A method for determining formation fluid sample quality includes analyzing sample capture data to identify distinguishing features indicative of whether a successful sample capture has occurred within a downhole tool. The method further includes prioritizing, based on the analysis, the sample capture data for transmission to a surface system.

19 Claims, 7 Drawing Sheets

(56) References Cited

U.S. PATENT DOCUMENTS

| | | | | |
|---|---|---|---|---|
| 4,860,580 | A * | 8/1989 | DuRocher | E21B 49/10 166/264 |
| 5,708,204 | A * | 1/1998 | Kasap | E21B 49/008 73/152.05 |
| 5,839,509 | A * | 11/1998 | Peterson | E21B 43/121 166/264 |
| 6,158,509 | A * | 12/2000 | Peterson | E21B 43/121 166/264 |
| 6,357,552 | B1 * | 3/2002 | Eitler | E21B 43/121 166/68 |
| 6,745,835 | B2 | 6/2004 | Fields | |
| 7,114,579 | B2 | 10/2006 | Hutchinson | |
| 7,367,694 | B2 | 5/2008 | Chen et al. | |
| 7,594,541 | B2 | 9/2009 | Ciglenec et al. | |
| 2003/0096423 | A1 * | 5/2003 | Ryan | B01F 11/0071 436/164 |
| 2004/0011525 | A1 | 1/2004 | Jones et al. | |
| 2005/0087367 | A1 | 4/2005 | Hutchinson | |
| 2005/0150287 | A1 * | 7/2005 | Carnegie | E21B 49/081 73/152.28 |
| 2005/0165554 | A1 * | 7/2005 | Betancourt | E21B 49/08 702/11 |
| 2005/0257629 | A1 | 11/2005 | Gilbert et al. | |
| 2006/0016594 | A1 | 1/2006 | Krueger et al. | |
| 2008/0156486 | A1 | 7/2008 | Ciglenec et al. | |
| 2008/0236821 | A1 | 10/2008 | Fielder | |
| 2009/0200016 | A1 | 8/2009 | Goodwin et al. | |
| 2010/0175873 | A1 * | 7/2010 | Milkovisch | E21B 49/008 166/264 |
| 2011/0114310 | A1 | 5/2011 | Ross et al. | |
| 2012/0018147 | A1 * | 1/2012 | Niconoff | E21B 49/10 166/250.01 |
| 2012/0018152 | A1 * | 1/2012 | Zuilekom | E21B 34/08 166/264 |
| 2012/0111571 | A1 * | 5/2012 | Eriksen | B01D 17/06 166/336 |
| 2013/0014940 | A1 * | 1/2013 | Fripp | E21B 43/2406 166/250.06 |
| 2013/0025855 | A1 * | 1/2013 | Glattetre | E21B 49/10 166/264 |

FOREIGN PATENT DOCUMENTS

| | | | | |
|---|---|---|---|---|
| EA | 015138 | B1 | 6/2011 | |
| EP | 1712733 | A1 | 10/2006 | |
| WO | WO 9400671 | A1 * | 1/1994 | E21B 23/06 |
| WO | 2010062635 | A2 | 6/2010 | |

OTHER PUBLICATIONS

Supplementary Search Report for corresponding EP App No. 12827845.4, dated Dec. 21, 2015, 4 pages.
Written Opinion for corresponding International App No. PCT/US2012/053362, dated Dec. 6, 2012, 2 pages.
Office Action for corresponding QA App No. QA/201403/00055, dated Aug. 24, 2015 4 pages.
Office Action for corresponding RU App No. 2014112352, dated Apr. 13, 2015, 7 pages.
Examination Report 94(3) EPC for corresponding EP application 12827845.4, dated May 9, 2016, 4 pages.
Decision on Grant for corresponding RU application 2014112352, dated May 5, 2016, 5 pages.
International Preliminary Report on Patentability issued in corresponding PCT application PCT/US2015/053362, dated Mar. 13, 2014, 7 pages.
International Search Report for International Application No. PCT/US2012/053362 dated Dec. 6, 2012.
Examination Report for corresponding AU App No. 2016244320, dated Oct. 6, 2017. 3 pages.
Examination Report for corresponding AU App No. 2012301699, dated Oct. 10, 2016, 3 pages.
Office Action 6493 issued in Mexican Patent application MX/a/2014/002387 dated Jan. 29, 2018. 2 pages.
Examination Report issued in Malaysian Patent application PI2014700477, dated Jan. 15, 2018. 4 pages.

* cited by examiner

SAMPLE CAPTURE PRIORITIZATION

BACKGROUND

This disclosure relates generally to the field of formation fluid sampling while drilling or drilling related operations (e.g., tripping, washing, reaming, etc.) are in progress. More specifically, the disclosure relates to communication methods that may inform the sampling instrument operator whether a sample chamber has been filled, notwithstanding limited bandwidth of signal channels used with while-drilling instruments.

Practice has shown that the opening and closure of a sample bottle carried by a wellbore formation sampling tool can be unreliable. To mitigate lost time resulting from a failed sample capture, it can be beneficial for an operator to learn of the failed sample capture as soon as possible—at least before opening a sample bottle on the rig site, and preferably when the sampling tool is still in the wellbore proximate the sampling position. This knowledge can be obtained by measuring the sampled fluid pressure and/or sample bottle volume during the capture of a fluid sample and communicating the foregoing measurements to the operator. Communication between a sampling while drilling tool and the surface, however, usually occurs using drilling fluid flow modulation ("mud pulse") telemetry, and thus the communication bandwidth is relatively limited.

SUMMARY

The present disclosure is directed to techniques for prioritizing sample capture data for transmission to the surface. According to certain embodiments, the sample capture data may be collected and analyzed downhole to determine whether a successful sample capture has occurred and/or to identify distinguishing features indicative of whether a successful sample capture has occurred. Based on the analysis, certain data points, calculated values, and/or portions of pressure curves may be prioritized and selected for transmission to the surface. Further, in certain embodiments, operation of the downhole tool may be automatically adjusted by a downhole controller to compensate for an unsuccessful sample capture. The prioritization of sample capture data may allow pertinent data to be received expediently at the surface, which may promote efficient sample capture decision making and adjustments. Other aspects and advantages of the prioritization techniques will be apparent from the description and claims which follow.

DETAILED DESCRIPTION

Figure 1:
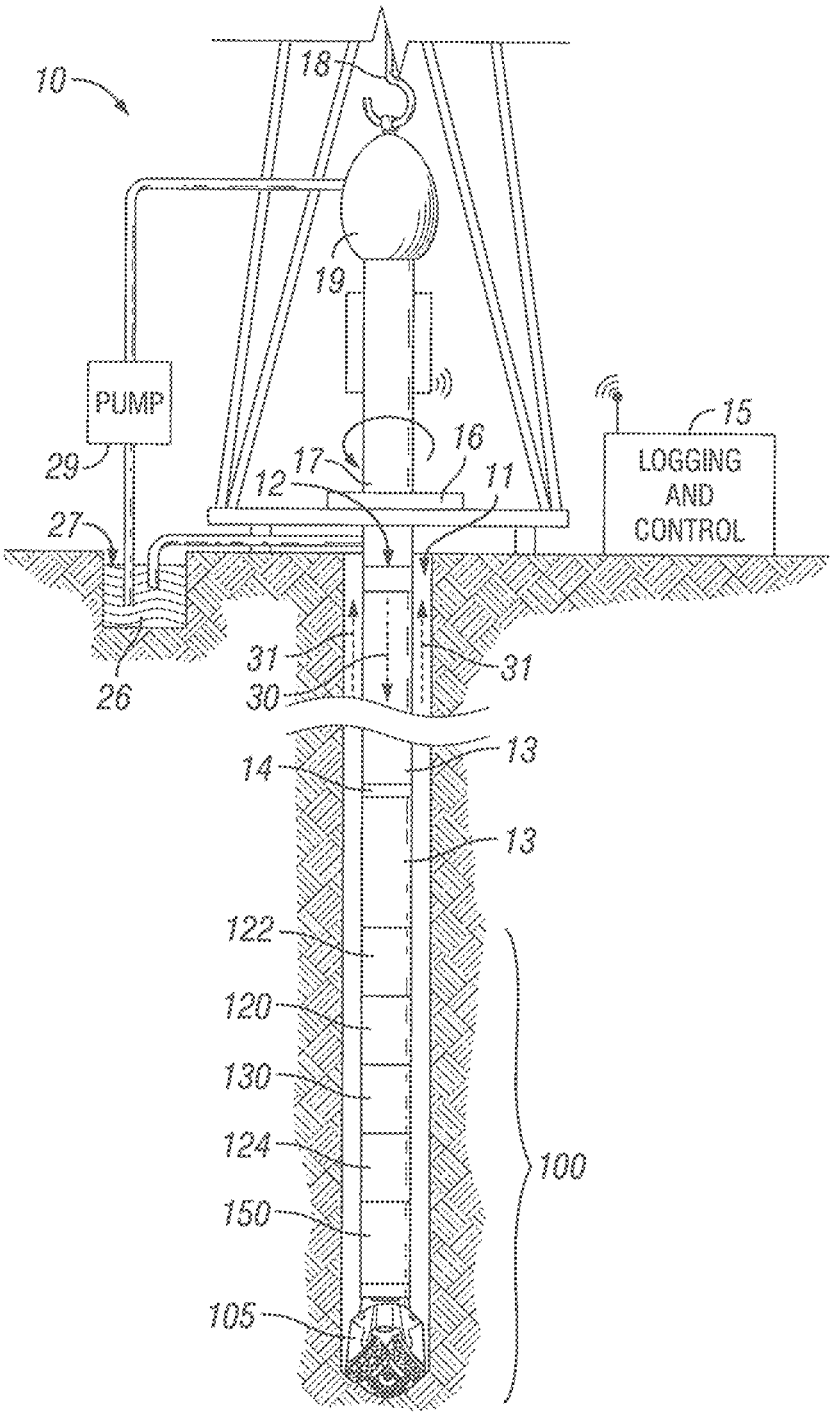
FIG. 1 is a front elevation view of an example of a wellsite system that includes a fluid sampling device.

FIG. 1 illustrates a wellsite system 10 in which example methods described herein may be employed. The wellsite system 10 may be located onshore or offshore. In this exemplary wellsite system 10, a borehole 11 is formed in subsurface formations by rotary drilling. Embodiments of the sample capture data prioritization techniques described herein also may be used with directional drilling, with wireline tools, and with wired drill pipe, among others.

A drill string 12, which may include individual pipe segments 13 connected by threaded connections 14, may be suspended within the borehole 11. The drill string 12 also includes a bottom hole assembly 100 that has a drill bit 105 at its lower end. At the surface, the wellsite system 10 includes a platform and derrick assembly positioned over the borehole 11. The platform and derrick assembly includes a surface control system 15, a rotary table 16, a kelly 17, a hook 18 and a rotary swivel 19. The surface control system 15 may include one or more processors or controllers for receiving data from the drill string 12 (e.g., via mud pulse telemetry) and for transmitting commands to the drill string 12 (e.g., via a downlink). The drill string 12 is rotated by the rotary table 16, which engages the kelly 17 at the upper end of the drill string. The drill string 12 is suspended from the hook 18, attached to a traveling block (not shown), through the kelly 17 and the rotary swivel 19, which permits rotation of the drill string relative to the hook 18. In the example of this embodiment, the surface system further includes drilling fluid 26 (e.g., drilling mud) stored in a pit 27 formed at the well site. A pump 29 delivers the drilling fluid 26 to the interior of the drill string 12 via a port in the swivel 19, causing the drilling fluid to flow downwardly through the drill string 12, as indicated by the directional arrow 30. The drilling fluid 26 exits the drill string 12 via ports in the drill bit 105, and then circulates upwardly through the annulus region between the outside of the drill string and the wall of the borehole, as indicated by the directional arrows 31. Accordingly, the drilling fluid 26 lubricates the drill bit 105 and carries formation cuttings up to the surface as it is returned to the pit 27 for recirculation.

The bottom hole assembly 100 of the illustrated embodiment includes logging-while-drilling (LWD) tools 120, 122, and 124, a measuring-while-drilling (MWD) tool 130, a rotary-steerable directional drilling system and/or motor 150, and the drill bit 105. The LWD tools 120, 122, and 124 may be housed in a special type of drill collar, as is known in the art, and can include various types of known logging tools. Further, the bottom hole assembly 100 may include any number of one or more LWD tools may be included within a bottom hole assembly 100. The LWD tools include capabilities for measuring, processing, and storing information. In the present embodiment, one of the LWD tools may include a sampling-while-drilling logging device, e.g., at 120. Further, in certain embodiments, the LWD tools 122 and 124 may include resistivity tools or nuclear (porosity and/or density) tools, among others. As may be appreciated, the relative vertical locations of the LWD tools 120, 122, and 124 may vary within the bottom hole assembly 100.

The MWD tool 130 may also be housed in a special type of drill collar, as is known in the art, and can contain one or more devices for measuring characteristics of the drill string and drill bit. The MWD tool may further include an apparatus (not shown) for generating electrical power to the downhole system. This may typically include a mud turbine generator powered by the flow of the drilling fluid, it being understood that other power and/or battery systems may be employed. In the present embodiment, the MWD tool includes one or more of the following types of measuring devices: a weight-on-bit measuring device, a torque measuring device, a vibration measuring device, a shock measuring device, a stick slip measuring device, a direction measuring device, and an inclination measuring device. Additionally, the MWD tool may include a storage and a telemetry system, for storing measurement information and for communicating with surface equipment.

Figure 2:
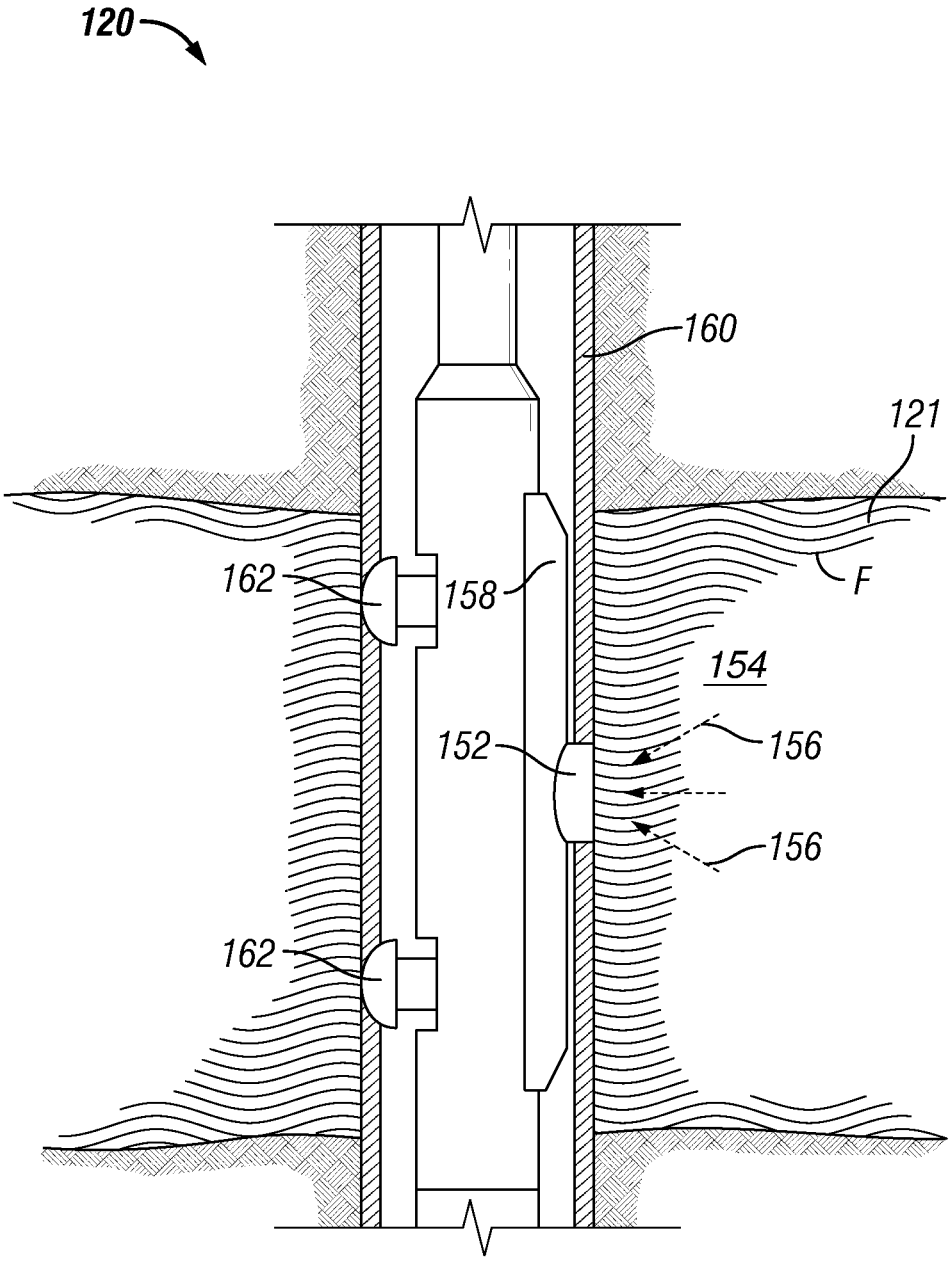
FIG. 2 is a front elevation view of an example of the fluid sampling device of FIG. 1 in more detail.

FIG. 2 is a simplified diagram of a sampling-while-drilling logging device used as the LWD tool 120. The LWD tool 120 may include a probe 152 for establishing fluid communication with the formation F and drawing fluid 154 into the tool, as indicated by the arrows 156. The probe 152 may be positioned in a stabilizer blade 158 of the LWD tool 120 and may be extended therefrom to engage the borehole wall 160. The stabilizer blade 158 includes one or more blades that are in contact with the borehole wall 160. Fluid drawn into the downhole tool using the probe 152 may be measured to determine, for example, pretest and/or pressure parameters. Additionally, the LWD tool 120 may be provided with devices, such as sample chambers, for collecting fluid samples for retrieval at the surface. Backup pistons 162 may also be provided to assist in applying force to push the drilling tool and/or probe against the borehole wall.

Figure 3:
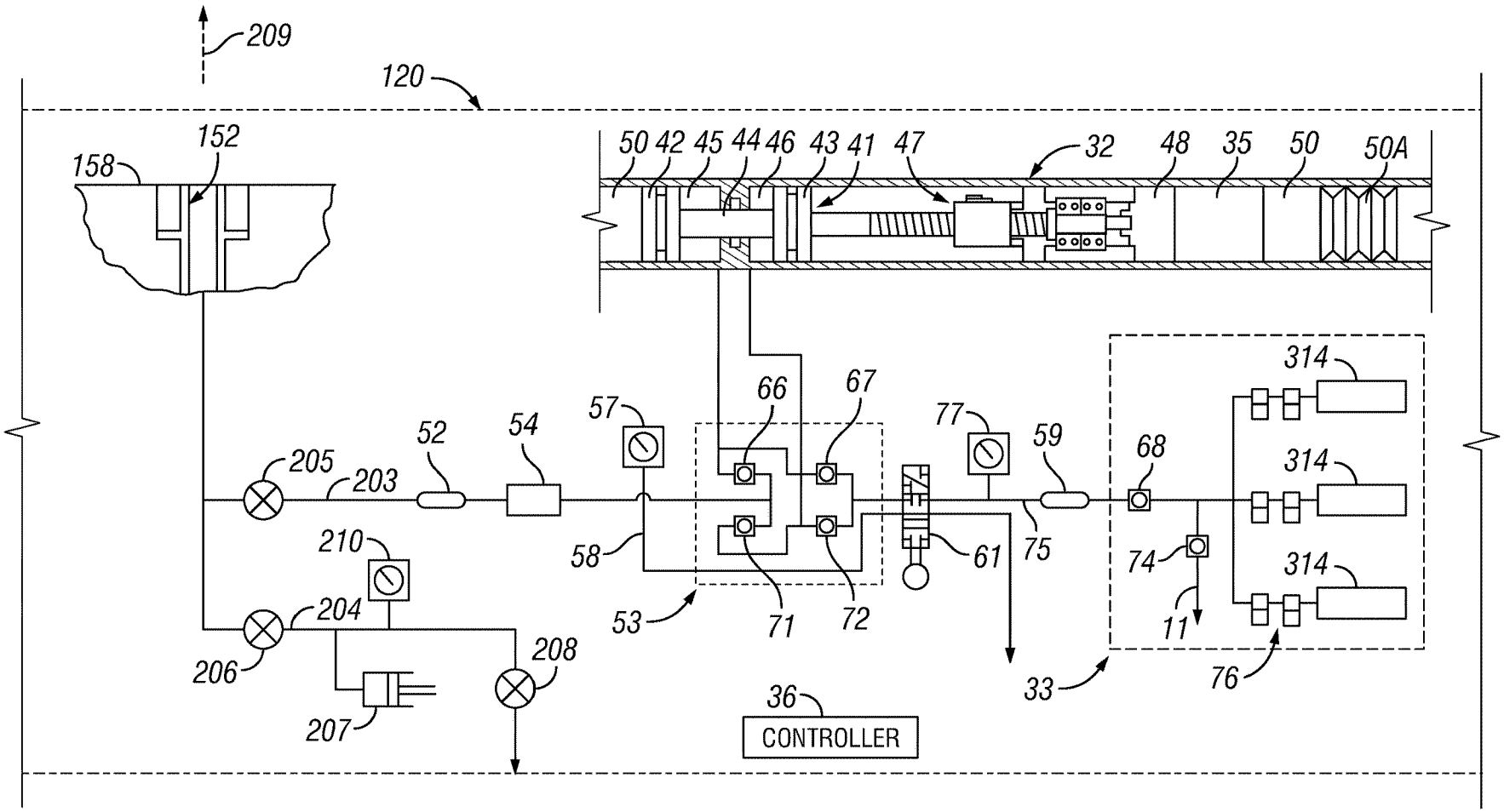
FIG. 3 is a schematic of the fluid sampling device of FIG. 1.

An example fluid pumping and sample capture system that may be employed within the LWD tool 120 is shown in FIG. 3. The system includes the extendable probe 152 disposed on the stabilizer blade 158, as described above with respect to FIG. 2. The system also includes a formation fluid pump and analysis module 32, a sample collection module 33, and a controller 36. The controller 36 may be integrated into the formation fluid pump and analysis module 32 or the sample collection module 33, or may be a stand-alone module. According to certain embodiments, the controller 36 may include one or more processors or control circuitry configured to execute instructions encoded on a non-transitory computer readable media, such as non-volatile storage included within the controller 36. Further, the non-volatile storage may store one or more algorithms or look up tables for performing the sample capture prioritization techniques described herein. Moreover, in certain embodiments, a separate controller may be included within sample collection module 33. In certain embodiments, the separate controller may communicate with the controller 36 and may govern operation of the valves 76.

The formation fluid pump and analysis module 32 includes a pump motor 35, whose operation may be governed by the controller 36 to drive a pump 41. Power to the pump motor 35 may be supplied from a dedicated turbine (not shown) which drives an alternator (not shown). The pump 41, in one embodiment includes two pistons 42, 43 connected by a shaft 44 and disposed within corresponding chambers 45, 46 respectively. The dual piston 42, 43 and chamber 45, 46 arrangement works through positive volume displacement. The piston 42, 43 motion is actuated via a planetary roller-screw 47, which is connected to the pump motor 35 via a gearbox 48. The gearbox or transmission 48 driven by the motor may be used to vary a transmission ratio between the motor shaft and the pump shaft. Alternatively, the combination of the motor 35 and the alternator (not shown) may be used to accomplish the same objective. In lieu of the planetary roller-screw 47 arrangement shown in FIG. 3, other means for fluid displacement may be employed, such as a lead screw or a separate hydraulic pump, which would output alternating high/low-pressure oil that could be used to reciprocate the motion of the piston assembly 42, 43, 44.

The formation fluid pump and analysis module 32 is shown with primary components in one particular arrangement, but other arrangements are possible and within the knowledge of those skilled in the art. The downhole formation fluid enters the tool string through the probe 152 and is routed to a valve block 53 via an extendable hydraulic/electrical connector 52. At the valve block 53, the fluid sample is initially pumped through a fluid identification unit 54. According to certain embodiments, the fluid identification unit 54 may include an optics module together with other sensors and a controller. Further, the fluid identification unit 54 may be employed to determine fluid composition—for each of oil, water and gas and the presence of drilling mud—and fluid properties, such as density, viscosity, resistivity, temperature, gas-oil ratio, and saturation pressure, among others. From the fluid identification unit 54, the fluid enters the fluid displacement unit (FDU) or pump 41 via the set of valves in the valve block 53

FIG. 3 also shows a schematic diagram of the probe 152 disposed, for example, in the stabilizer blade 158 of the tool 120. Two flow lines 203, 204 extend from the probe 201. The flow lines 203, 204 can be independently isolated by manipulating a sampling isolation valve 205 and a pretest isolation valve 206. The flow line 203 connects the formation fluid pump and analysis module 32 to the probe 152. The flow line 204 may be used for pretests.

During a pretest, the sampling isolation valve 205 to the formation fluid and pump analysis module 32 is closed; the pretest isolation valve 206 to a pretest piston 207 is open; and an equalization valve 208 is closed. The probe 201 is extended toward the formation as indicated by an arrow 209 and, when extended, is hydraulically coupled to the formation F (FIG. 2). The pretest piston 207 is retracted in order to lower the pressure in the flow line 204 until the mud cake is breached. The pretest piston 207 is then stopped and the pressure in the flow line 204 increases as it approaches the pressure of the formation. Formation pressure data can be collected during the pretest. The pretest can also be used to determine whether the probe 152 and the formation are hydraulically coupled. The pressures acquired during the operation of the pretest may be analyzed to determine the formation mobility—a property of the rock/fluid system which determines the ease with which fluid may be extracted from the formation—and, together with the just-determined formation pressure, a decision may be made whether a formation fluid sampling operation should be initiated at that location. The probe 152 remains hydraulically coupled to the formation for the duration of the sampling operation.

If the decision is made to proceed with fluid sampling, the pretest isolation valve 206 is closed, the sampling isolation valve 205 is opened, and pumping is initiated with the pump 41. In certain embodiments, a pressure sensor 57 may be employed to detect when the pressure in the flow line 203 is equal to the formation pressure, as detected by pressure sensor 210. The sampling isolation valve 205 may be opened when the pressure has equalized in order to reduce pressure shocks. During sampling, the withdrawn fluid is directed to either one of the two displacement chambers 45 or 46. The pump 41 operates such that there is always one chamber 45 or 46 drawing fluid in, while the other chamber 45 or 46 is expulsing fluid. Depending on the fluid routing and equalization valve 61 setting, the exiting liquid is pumped back to the borehole 11 (or borehole annulus) (FIG. 1) or through an hydraulic/electrical connector 59 to the sampling collection module 33. The sampling collection module 33 includes sample chambers 314, which may receive the formation fluid. While only three sample chambers 314 are shown, it will be noted that more or fewer than three chambers 314 may be used.

The pumping action of the piston assembly 42, 43, 44 is achieved via the planetary roller screw 47. The pump motor 35 and associated gearbox 48 drives the planetary roller screw 47 in a bi-directional mode under the direction of the controller 36. Gaps between the components may be filled with oil 50 and an annular bellows compensator is shown at 50*a*. During intake into the chamber 45, fluid passes into the valve block 53 and past a check valve 66 before entering the chamber 45. Upon output from the chamber 45, fluid passes through a check valve 67 to a fluid routing and equalization valve 61 where it is either dumped to the borehole 11 or passed through the hydraulic/electrical connector 59 and a check valve 68 into one of the chambers 314. Similarly, upon intake into the chamber 46, fluid passes through a check valve 71 and into the chamber 46. Upon output from the chamber 46, fluid passes through a check valve 72, through the fluid routing and equalization valve 61, and either to the borehole 11 or to the sample collection module 33

During a sample collecting operation, fluid is initially pumped to the module 32 and exits the module 32 via the fluid routing and equalization valve 61 to the borehole 11. When it has been decided to capture a sample, the fluid routing and equalization valve 61 is closed and the pumped fluid flows through a sampling flow line 75, through check valve 68 and relief valve 74, and into the borehole 11. This action flushes the flow line 75 from residual liquid prior to filling a sample bottle 314 with new or fresh formation fluid. Opening and closing of a sample bottle 314 is performed with sets of dedicated seal valves, shown generally at 76, which are linked to the controller 36. A pressure sensor 77 is disposed in the flow line 75 and may be employed to detect that the sample chambers 314 are full. A relief valve 74 is disposed off the flow line 75 and may be employed as a safety feature to avoid over pressuring the fluid in the sample chambers 314. The relief valve 74 may also be used to dump fluid to the borehole 11 and to remove high pressure fluid from the tool at the surface.

Figure 4:
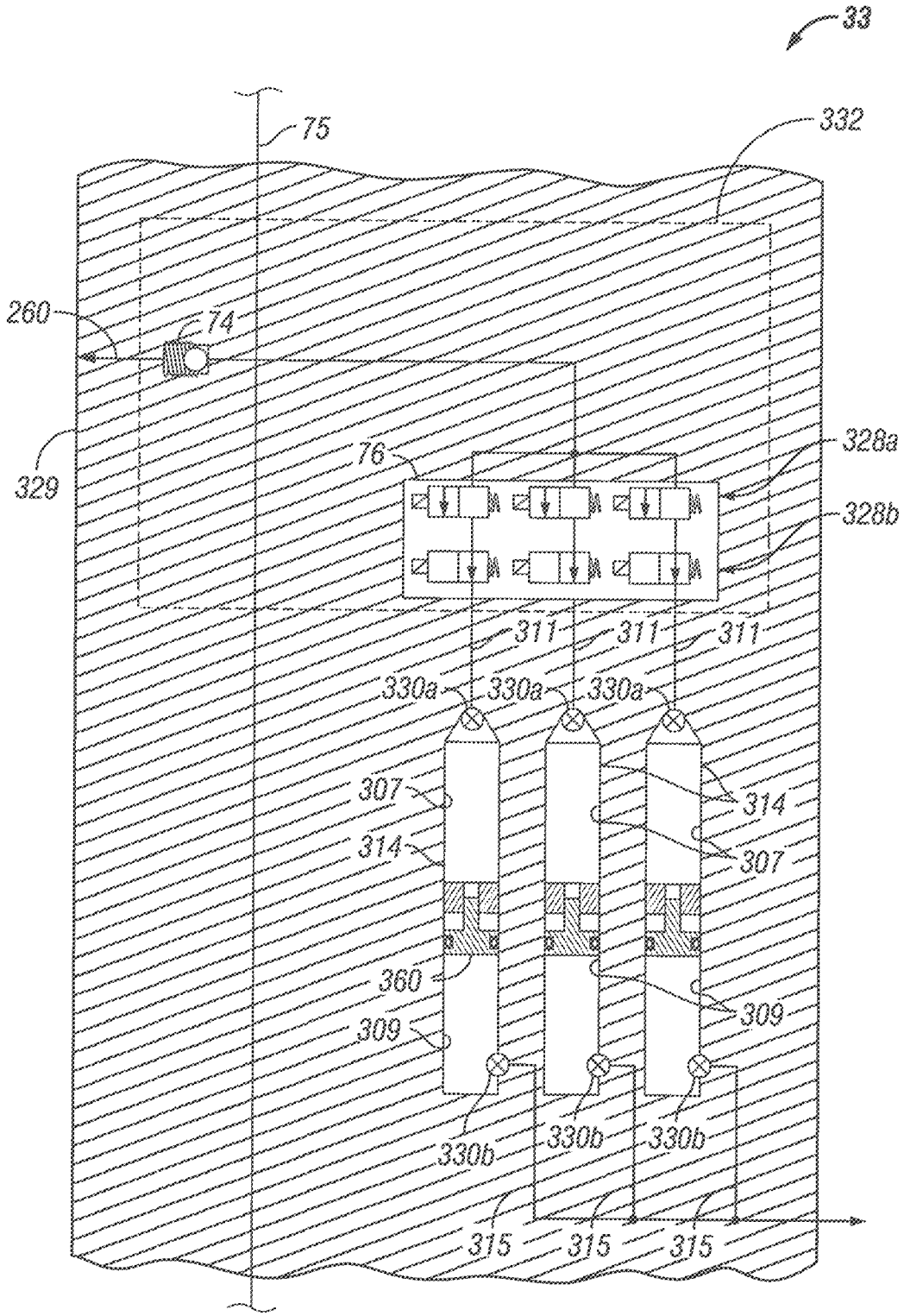
FIG. 4 is a schematic of the sample collection module of the fluid sampling device of FIG. 1.

The sample chambers and associated control valves of the sample collection module 33 may better understood with reference to FIG. 4. An example sample chamber module 33 may include a control valve section 332 and one or more sample chambers (e.g., sample bottles) 314. The sample chambers 314 may include an upper volume 307 in communication with a shut off valve 330*a*. A lower volume 309 may be in communication with a shut off valve 330*b*. The shut off valves 330*b* may be in fluid communication with the wellbore 11 through flow lines 315. Intake lines 311 may connect each sample chamber's upper volume 307 to the seal valves 76. The seal valves 76 may include, for each sample chamber 314, a normally closed valve 328*a* and a normally open valve 328*b*. The pump 41 (FIG. 3) operates to move fluid into the sample chamber module 33 through the sample flow line 75. The flow line 75 may be connected to a discharge line 260 through the relief valve 74 that provides a small back pressure to the fluid flow. When a control signal is sent from the controller 36 (FIG. 3), one of the normally closed valves 328*a* may be opened. Continued pumping of fluid displaces a piston assembly 360 separating the upper and lower volumes in the respective sample chamber 314 against wellbore fluid pressure. When the piston assembly 360 has been fully displaced, pressure will increase in the sample chamber until a predetermined overpressure is reached. Then, one of the normally open valves 328*b* will close automatically (e.g., in response to the overpressure). Alternatively, the normally open valves 328*b* may be closed by a command sent to the sampling tool from the surface control system 15 (e.g., via a downlink).

As explained earlier, the telemetry rate of typical mud pulse systems may make it impractical to observe and act upon rapid pressure changes with respect to time. Such changes may be indicative of whether a sample was properly captured in one or more of the sample chambers 314. Given that only a relatively small number of sample chambers may be transported down hole on a sampling tool in a single descent and that not all samples necessarily have the same value in evaluating the worth of a formation, it is desirable to know whether samples were recovered successfully in those formations having the greatest value. Further, determining whether samples were captured successfully assists in appropriately prioritizing the order of sample recovery.

FIGS. 5-8 depict graphs showing the pressure response during sampling. The x-axes 396 represent time (on a compressed scale), and the y-axes 398 represent pressure for the upper curves 400, 402, 404, and 405 and piston position for the lower curves 406, 408, 410, and 411. In particular, for the upper curves 400, 402, 404, and 405, the y-axes 398 may represent the pressure in the sample flow line 75, which may be detected by pressure sensor 77, as shown in FIG. 3. Further, for the lower curves 406, 408, 410, and 411, the y-axes 398 may represent the position of the piston assembly 42-44 for the pump 41, as shown in FIG. 3. As shown by the lower curve 406, a piston stroke 412 may occur each time the piston assembly 42-44 moves to the right or left, to move the pistons 42 and 43 within their respective chambers 45 and 46. As shown by the upper curve 400, a corresponding pressure change 414 occurs with each piston stroke 412, as fluid is moved into and out of the pump chambers 45 and 46.

Figure 5:
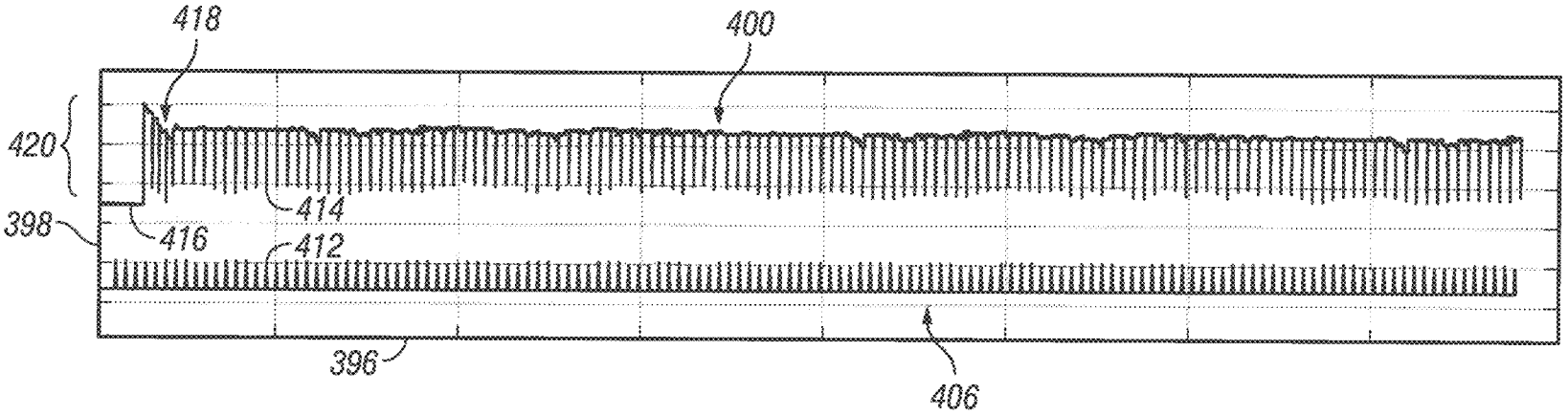
FIG. 5 is a chart depicting initiation of fluid sampling.

FIG. 5 depicts the start of a sampling operation. At the beginning of the sampling period, the pressure 416 in the sample flow line 75 may be approximately equal to the wellbore pressure. As discussed above with respect to FIG. 3, the sampling isolation valve 205 may be opened to direct fluid into the sample flow line 75. The relief valve 74, along with check valve 68, provides a back pressure on the sample flow line 75. Accordingly, at the start of sampling, a pressure spike 418 may occur as fluid begins to flow through the sample flow line 75. The pressure change that overcomes the back pressure from the check valve 68 may generally be referred to as the check valve delta pressure 420 and may be shown in FIG. 5 as the difference between the pressure spike 418 and the wellbore pressure 416.

Figure 6:
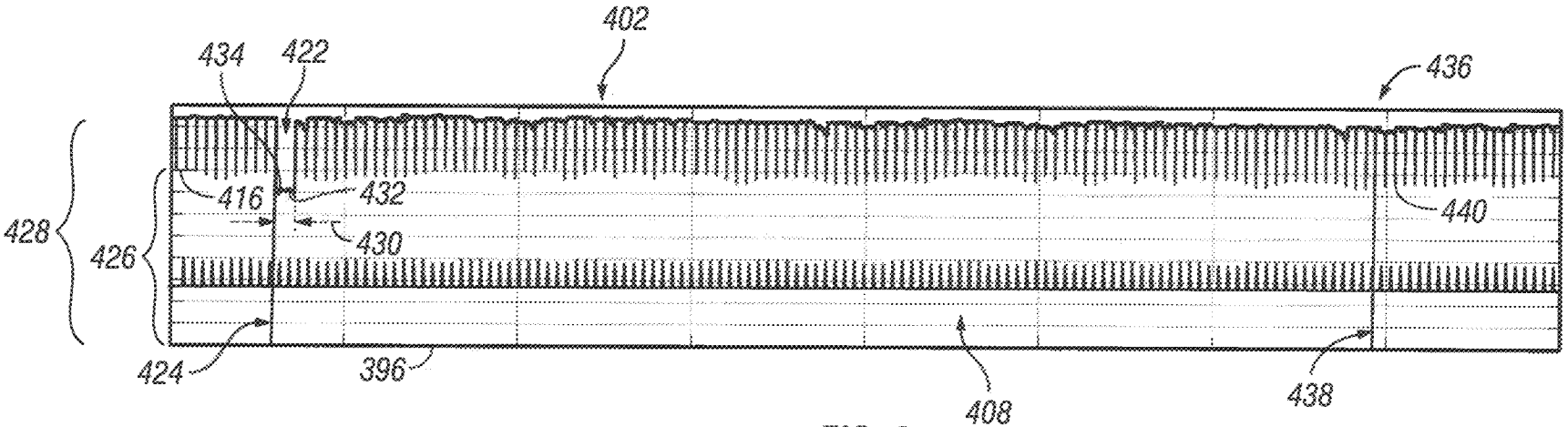
FIGS. 6-9 are charts depicting sample capture events.

According to certain embodiments, the check valve delta pressure 420 may be employed to detect whether a sample bottle has opened. For example, FIG. 6 depicts a sample capture event 422 where a sample bottle has opened, filled, and closed. A pressure decrease 424 occurs when the sample bottle is opened. Upon bottle opening, a pressure drop 426 below the wellbore pressure 416 may occur. In certain embodiments, a pressure drop 426 below the wellbore pressure 416 that is greater than the amount of the check valve delta pressure 420 may indicate that the sample bottle has opened (e.g., valve 328*a* has opened). In other embodiments, the total pressure drop 428 may be employed to determine that a sample bottle has opened. After opening, the pressure may increase for a fill period 430, while the fluid enters the sample chamber 314 and displaces the piston 360. The total duration of the fill period 430 indicates the time that sample fluid is directed to a sample chamber 314, rather than flowing to the wellbore 11.

During the fill period 430, the lower pressure 432 may be approximately equal to the wellbore pressure 416, which indicates proper operation of valve block 53. In certain embodiments, the number of pressure drops to the lower pressure 432 indicates the number of pump strokes that occurred during the fill period 430. The number of pump strokes may be multiplied by the volume of the pump stroke to determine the volume of sample fluid that has entered the sample chamber 314. As discussed further below with respect to FIGS. 7 and 8, the curves 406, 408, 410, and 411 may be analyzed to determine the volume of the pump stroke during the corresponding pressure events. The upper pressure 434 during the fill period 430 may be approximately equal to the pressure that displaces the sample chamber piston 360. The cumulative duration of the upper pressure 434 indicates the time that sample fluid entered the sample chamber 314. In certain embodiments, the cumulative duration may be multiplied by the flow rate of the pump 41 to determine the volume of sample fluid that has entered the sample chamber 314.

When filling is complete, the pressure in the sample flow line 75 may increase and the valve 328*b* may be closed. Fluid may then be directed to the wellbore until another sample event 436 occurs. Sample event 436 depicts a sample failure where, although the sample bottle opened, no filling occurred. For example, a pressure decrease 438 occurs indicating that the sample bottle has opened (e.g., by opening of valve 328*a*). However, rather than being followed by a fill period 430, the pressure decrease 438 is followed by a pressure change 440, which may represent a piston stroke when sampling is not occurring, similar to the pressure changes 414 discussed above. The lack of a fill period during the sample event 436 indicates that although the sample bottle opened, a sampling error may have occurred. For example, valve 330*a* or 330*b* may have been inadvertently closed at the surface (e.g., operator error) or the piston 360 may be locked from moving.

Figure 7:
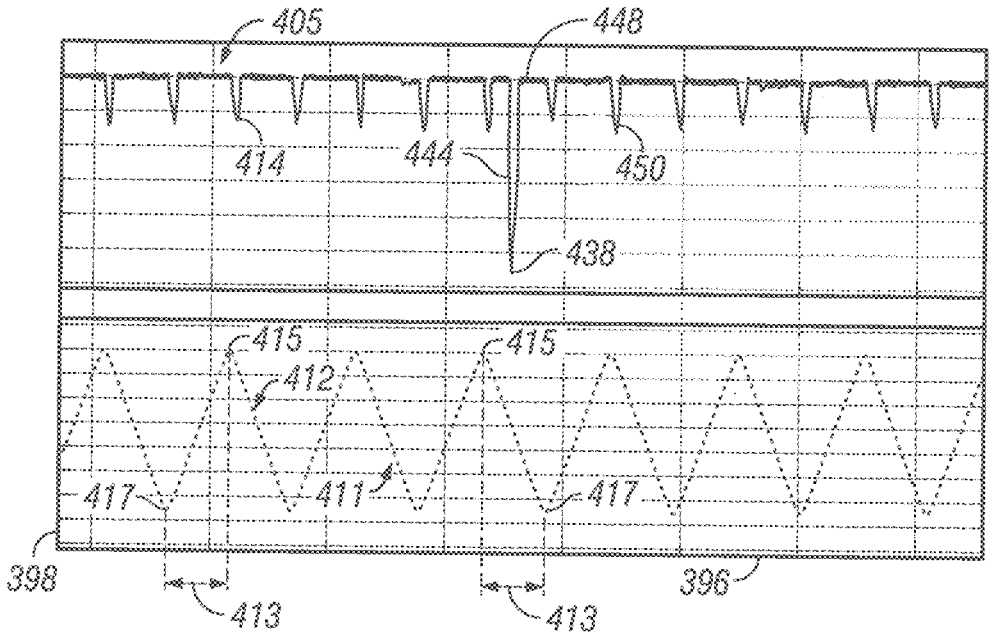
Figure 8:
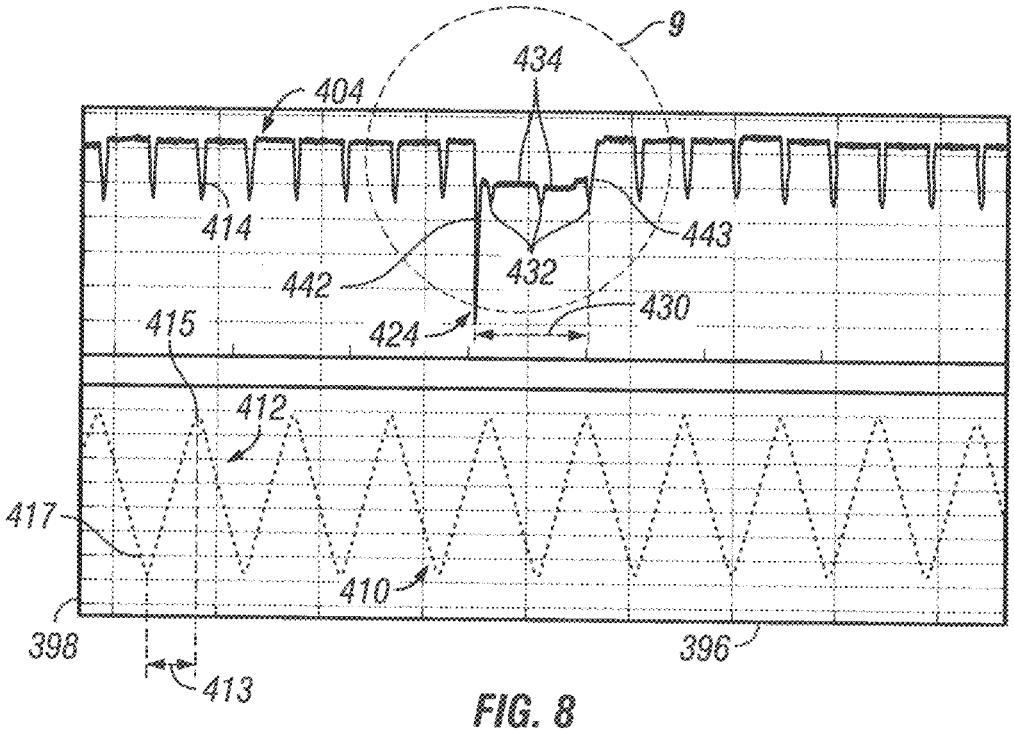

FIGS. 7 and 8 depict additional examples of pressure response during sample capture. Further, FIGS. 7 and 8 depict the piston strokes 412 in more detail. Each piston stroke 412 may last for a duration 413 that extends between a first piston position 417, where the piston has moved to the left in FIG. 3, and a second piston position 415, where the piston has moved to the right in FIG. 3. The duration 413 of each piston stroke may be employed to determine the volume of fluid displaced by each piston stroke (e.g., the pump stroke volume).

FIG. 7 also depicts another example of a pressure response during a failed sample capture. A pressure decrease 438 has occurred, which indicates that the sample bottle valve 328*a* has opened. A pressure rise 444 then occurs. However, rather than rising to a pressure approximate to the wellbore pressure as shown in FIG. 6, the pressure rises to the upper pressure 448, which corresponds to piston stroke upper pressure during non-sampling periods. The rise to the upper pressure 448, rather than a rise to a pressure approximately equal to the lower pressure 450 that occurs during a non-sampling period piston strokes, indicates that a sample has not properly been captured. For example, as discussed above with respect to FIG. 5, a valve 330*a* or 330*b* may have been inadvertently closed or the sample chamber piston 360 may be immobile.

FIG. 8 depicts another example of a pressure response during a successful sample capture. A pressure decrease 424 occurs in response to opening of the sample bottle valve 328*a*. A pressure rise 442 then occurs as the fluid enters the sample chamber and displaces the sample piston 360. During the fill period 430, the drops to the lower pressure 432 indicate the number of pump strokes. The periods of upper pressure 434 represent time when the sample chamber is filling. As describe above with respect to FIG. 6, the upper and lower pressure durations during the fill period 430 can be employed to determine the volume of sample fluid that has entered the sample chamber 413. At the end of the fill period 430, a pressure rise 443 occurs as pressure in the sample chamber builds to close the sample bottle seal valve 328*b*.

Figure 9:
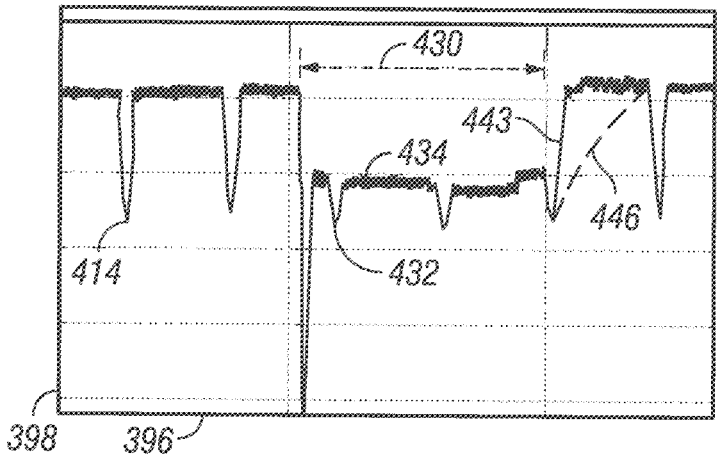

FIG. 9 is an enlarged view of the fill period 430 of FIG. 8. According to certain embodiments, the slope of the pressure rise 443 may be employed to determine the fluid compressibility of the sample fluid collected within the sample chamber. For example, a steeper slope may indicate a less compressible fluid, while a shallower slope may indicate a more compressible fluid. By way of comparison, curve 446 is shown in FIG. 9 as another example of a pressure rise that may occur as the pressure in the sample chamber builds upon the completion of filling. Curve 446 has a shallower slope than the slope of pressure rise 443, which may indicate a more compressible fluid. According to certain embodiments, look up tables or algorithms that correlate slope of the pressure rise 443 to fluid compressibility may be stored within the LWD tool 120 and employed by the controller 36 (FIG. 3) to calculate fluid compressibility. The controller 36 may be programmed to characterize the slope of the pressure rise and transmit a bit, or bit sequence, to the surface control system 15 to indicate the estimated fluid compressibility.

Figure 10:
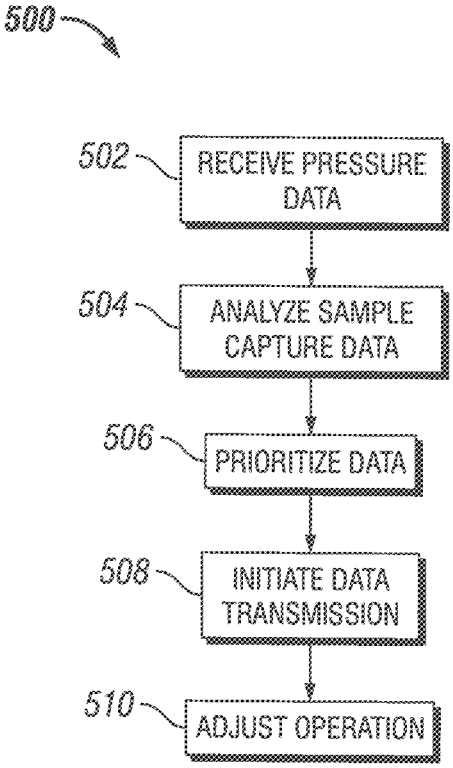
FIG. 10 is a flowchart depicting a method for prioritizing sample capture data transmission.

FIG. 10 is a flowchart depicting a method 500 that may be employed by the controller 36 to prioritize sample capture data for transmission to the surface. To perform the method 500, the controller 36 (FIG. 3) may execute code or algorithms, which may be stored in non-volatile memory of the LWD tool 120. The method 500 may begin by receiving (block 502) pressure data. For example, the controller 36 may receive pressure data over time from the pressure sensor 77 (FIG. 3) disposed in the sample flow line 75. The controller 36 also may receive pressure data from pressure sensors 57 and 210, which may indicate the pressure in the wellbore.

The controller 36 may then analyze (block 504) the pressure data to determine distinguishing data features that are indicative of whether a sample capture was successful. For example, as shown in FIG. 5, the controller 36 may determine if the maximum pressure 418 detected is approximately equal to a predetermined pressure, such as the opening pressure of the check valve 68. A maximum pressure 418 that is approximately equal to the opening pressure of the check valve 68 may indicate that the check valve 68 is functioning correctly and that fluid has entered the sample collection module 33. On the other hand, if the maximum pressure 418 is a certain value above or below the opening pressure of the check valve 68, an error may have occurred that inhibits fluid from entering the sample collection module 33. For example, the check valve 68 may be obstructed or malfunctioning.

In another example, as shown in FIGS. 5 and 6, the controller 36 may determine if the difference 426 between the wellbore pressure 416 and the lowest pressure 424, which may occur upon opening of the valve 328*a*, is greater than the check valve delta pressure 420 (e.g., the difference between the maximum pressure 418 and the wellbore pressure 416). A difference 426 that is greater than the check valve delta pressure 420 may indicate that valve 328*a* has opened to allow fluid into the sample chamber 314. In a further example, the controller 36 may determine the duration of the continuous interval that the pressure values were below the check valve opening pressure, which may generally correspond to the maximum pressure 418 shown in FIG. 5. As shown in FIGS. 6 and 8, an interval longer than a certain duration may indicate that a fill period 430 has occurred, while a shorter interval may indicate a filling failure. For example, a sample event 436 (FIG. 6) may have occurred where although the valve 328*a* opened, another valve, such as valve 330*a* or 330*b* may have been closed. If the duration of the interval that the pressure values were below the maximum pressure 418 indicates that a fill period occurred, the controller 36 may verify the fill period. For example, the controller may determine if the upper pressures 434 within the fill period 430 are approximately equal to the displacement pressure for the sample bottle piston 360. In certain embodiments, the expected displacement pressure for the sample bottle piston 360 and the expected check valve opening pressure may be stored within a non-volatile memory of the controller 36. As may be appreciated, various pressure comparisons and time dependent analyses may be performed to determine the distinguishing data features that indicate whether a successful sample capture has occurred. Accordingly, the foregoing are provided by way of example only, and are not intended to be limiting. Further, in certain embodiments, the data analysis may involve determining downhole whether a successful sample capture has occurred.

The controller 36 may then prioritize (block 506) the sample capture data for transmission to the surface. The prioritization of the sample capture data may include selecting certain data points or calculated values based on the data points for transmission to the surface. For example, the controller 36 may select certain values, such as maximum pressures, minimum pressures, pressure durations, pump stroke volumes, and the number of pressure spikes, among others, for transmission to the surface. In certain embodiments, the amount and type of data selected for transmission to the surface may depend on whether the sample capture was successful. For example, if the sample capture was unsuccessful, the controller 36 may only select the maximum pressure value 418 for transmission to the surface. As discussed above, a maximum pressure value that is not approximately equal to the opening pressure of the check valve 68 may indicate that fluid failed to enter the sample module 33. In other embodiments, other data, such as the duration of the interval that the pressure was below the check valve opening pressure, also may be transmitted to the surface. Moreover, in certain embodiments, rather than transmitting the pressure data itself, a flag or other indicator representing a successful or unsuccessful sample capture may designated for transmission to the surface.

The following paragraphs provide additional examples of data that may be prioritized and selected for transmission to the surface. According to certain embodiments, the below data may be transmitted to the surface for successful sample captures. However, in other embodiments, the below data may be transmitted to the surface for certain unsuccessful sample captures as well. According to certain embodiments, the maximum pressure value 418 and the duration of the interval that the pressure was below the check valve opening pressure may be transmitted to the surface. In another example, the data may include the upper pressure value 434 that occurs within the fill period 430. As discussed above, the upper pressure value 434 may be approximately equal to the displacement pressure of the sample bottle piston when a successful sample capture occurs. Accordingly, this value may be analyzed at the surface to determine if the sample bottle piston has moved properly, which in turn may provide verification of a successful sample capture. Further, the data may include the minimum value of the pressure data received during the fill period 430. A minimum pressure that is approximately equal to the wellbore pressure may indicate that the valve block 53 is functioning properly.

The data also may include values that allow calculation of the sample fill volume. For example, the cumulative duration of the upper pressures 434 within the fill period 430 may be transmitted to the surface. As discussed above with respect to FIG. 5, the duration of the upper pressures 434, which represents the fill time, may be multiplied by the pump flow rate to determine the sample volume. In another example, the number of pressure spikes 432 within the fill period 430 may be transmitted to the surface, where the number of pressure spikes may be multiplied by the pump stroke volume to determine the sample volume. In the foregoing examples, the controller 36 may calculate the cumulative duration at the upper pressure 434 and the number of pressure spikes 432 from the raw pressure data received from the pressure sensor 77. Further, the controller 36 may calculate the pump stroke volume based on the piston position curves 406, 408, 410, and 411. The data also may include fluid compressibility values. For example, as shown in FIG. 9, the controller 36 may calculate the compressibility of the sample fluid based on the pressure rise 443 or 446.

In summary, the controller 36 may analyze the sample capture raw data and select certain data points and calculated values for transmission to the surface. The selection of certain data points for transmission, rather than transmitting the entire set of raw data, may allow data representing sample capture quality to be received relatively quickly at the surface, given the limited transmission bandwidth. Moreover, in certain embodiments, portions of the pressure curves 400, 402, 404, and 405 may be selected for transmission to the surface. For example, in certain embodiments, the portion of the pressure curve representing the fill period 430 and subsequent pressure rise 443 may be selected for transmission to the surface. Further, prioritization may occur within the set of selected and prioritized data to determine which data is transmitted first when bandwidth is available. As may be appreciated, various data points and calculated values may be prioritized for transmission to the surface depending on properties of the formation, and the surface information desired, among others.

After the controller 36 has prioritized the data, the controller 36 may initiate (block 508) transmission of the prioritized data to the surface. For example, the controller 36 may transmit control signals to a telemetry module included within drill string 12, such as within the MWD tool 130 (FIG. 1), to initiate transmission of the prioritized data to the surface control system 15 via mud pulse telemetry. In certain embodiments, the controller 36 may specify the order of transmission of the prioritized data, in addition to specifying the prioritized data itself. As discussed above the prioritized data may include selected data points, calculated values, portions of the pressure curve, and indicators identifying a successful or unsuccessful sample capture, among others. In certain embodiments, the surface controller 15 may include a display configured to display the prioritized data. In some examples, the tool operator may adjust operation of the tool from the surface (e.g., via a downlink) to make further attempts to obtain a sample when the data indicates an unsuccessful sample capture.

Further, in certain embodiments, the controller 36 may adjust (block 510) operation of the tool based on the prioritized data. For example, if the data indicates that an unsuccessful sample capture has occurred, the controller 36 may re-initiate sampling using another sample chamber 314.

Further, the controller 36 may analyze the sample capture data to determine the cause of the unsuccessful sample capture. For example, as discussed above with respect to FIG. 8, if the data does not include a pressure drop 438 that indicates opening of the sample chamber valve 238*a*, the controller 36 may again attempt to open the sample chamber valve 238*a*.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

measuring pressures of a formation fluid, via a pressure sensor located between a check valve and a formation, in a sample flowline with respect to time to obtain sample capture data;

analyzing, via a controller of a downhole tool, the sample capture data to determine distinguishing features indicative of whether the sample capture data is associated with a successful sample capture or an unsuccessful sample capture, wherein the analysis of the sample capture data comprises:

comparing a first pressure of the sample capture data to an expected opening pressure for the check valve; and determining that the sample capture data is associated with the unsuccessful sample capture in response to determining the first pressure is less than the expected opening pressure;

transmitting a control signal to open a control valve in fluid communication with the sample flow line to direct the formation fluid into a sample chamber in response to determining the unsuccessful sample capture;

opening the control valve based on the control signal;

prioritizing, based on the analysis, the sample capture data for transmission to a surface system such that the sample capture data associated with the successful sample capture has a higher priority than the sample capture data associated with the unsuccessful sample capture; and transmitting the sample capture data to the surface system in accordance with the prioritization.

2. The method of claim 1, wherein the first pressure is a maximum pressure of the sample capture data.

3. The method of claim 1, wherein the analysis of the sample capture data comprises determining a duration of an interval where pressure data is below a threshold to identify a fill period.

4. The method of claim 1, wherein the analysis of the sample capture data comprises identifying a fill period and comparing a maximum pressure during the identified fill period to an expected displacement pressure for a sample chamber piston.

5. The method of claim 1, wherein the prioritizing of the sample capture data further comprises selecting raw data points for transmission to the surface system.

6. The method of claim 1, wherein the prioritizing of the sample capture data further comprises selecting a maximum pressure of the sample capture data for transmission to the surface system.

7. The method of claim 1, wherein the prioritizing of the sample capture data further comprises selecting a pump stroke volume corresponding to a fill period for transmission to the surface system.

8. The method of claim 1, wherein the sample capture data comprises sample flow line pressure data with respect to time and piston position data for a sampling pump.

9. A method comprising:

extending a probe of a downhole tool into sealing contact with a formation;

operating a pump to withdraw fluid from the formation through the probe;

pumping the fluid through a sample flowline;

measuring pressure, via a pressure sensor located between a first sample chamber and the formation, of the fluid in the sample flowline with respect to time to obtain sample capture data;

transmitting a first control signal to open a first control valve in fluid communication with the sample flow line to direct the fluid into the first sample chamber;

analyzing, via a controller of the downhole tool, the sample capture data to determine whether a successful sample capture of the fluid has occurred within the first sample chamber;

transmitting a second control signal to open a second control valve in fluid communication with the sample flow line to direct the fluid into a second sample chamber in response to determining an unsuccessful sample capture, wherein determining the unsuccessful sample capture comprises determining that the measured pressure is less than an expected opening pressure of the first control valve; and opening the second control valve based on the second control signal.

10. The method of claim 9, comprising transmitting a third control signal to open the first control valve in response to determining the unsuccessful sample capture.

11. The method of claim 9, comprising prioritizing, based on the analysis, the sample capture data for transmission to a surface system.

12. A downhole tool comprising:

a probe extendable to engage a formation;

a pump operable to withdraw fluid from the formation through the probe and into a sample flowline;

a first pressure sensor located between a check valve and the formation and disposed in the sample flowline for measuring sample flowline pressure to obtain sample capture data;

a controller configured to analyze the sample capture data to identify distinguishing features indicative of whether a successful sample capture of the fluid has occurred, and configured to prioritize, based on the analysis of the sample capture data, the sample capture data for transmission to a surface system such that the sample capture data associated with the successful sample capture has a higher priority than the sample capture data associated with an unsuccessful sample capture, and wherein the controller is configured to determine the unsuccessful sample capture based at least in part on the measured sample flowline pressure being less than an expected opening pressure of the check valve; and a data transmission system configured to transmit the sample capture data to the surface system according to the prioritization.

13. The downhole tool of claim 12, wherein the pump comprises a bidirectional piston and wherein the sample capture data comprises position data for the bidirectional piston.

14. The downhole tool of claim 12, wherein the sample capture data comprises the sample flowline pressures measured with respect to time.

15. The downhole tool of claim 12, comprising a second pressure sensor for measuring wellbore pressures, and wherein the sample capture data comprises the wellbore pressures.

16. The downhole tool of claim 12, comprising the check valve disposed in the sample flow line to direct the fluid into one or more sample chambers.

17. The downhole tool of claim 12, comprising a sample seal valve disposed in fluid communication with the sample flow line and actuatable to direct the fluid into a sample chamber, wherein the controller is configured to analyze the sample capture data to detect a malfunction of the sample seal valve.

18. The downhole tool of claim 12, wherein the controller is configured to analyze the sample capture data to identify a post filling pressure rise and to analyze a slope of the post filling pressure rise to estimate a compressibility of the fluid.

19. The downhole tool of claim 12, comprising a sample chamber having a piston moveable in response to the fluid entering the sample chamber, wherein the controller is configured to analyze the sample capture data to calculate a cumulative duration of intervals during a filling period where the pressure approximately equal a displacement pressure for the piston of the sample chamber.

* * * * *